US005121509A

United States Patent [19]

Juple

[11] Patent Number: 5,121,509

[45] Date of Patent: Jun. 16, 1992

[54] OVERFLOW AND DRAIN FITTINGS FOR SANITARY DEVICES

[75] Inventor: Pierre Juple, Jona, Switzerland

[73] Assignees: Geberit Ag, Jona, Switzerland; "KERAMAG" Keramische Werke Aktiengesellschaft, Ratingen, Fed. Rep. of Germany

[21] Appl. No.: 665,405

[22] Filed: Mar. 5, 1991

[30] Foreign Application Priority Data

Mar. 6, 1990 [CH] Switzerland ..... 715/90

[51] Int. Cl.[5] ..... E03C 1/232; E03C 1/24

[52] U.S. Cl. ..... 4/669; 4/686

[58] Field of Search ..... 4/198-206, 4/295, 541, 542, 544

[56] References Cited

U.S. PATENT DOCUMENTS

| | | | |
|---|---|---|---|
| 267,156 | 11/1882 | Cooper | 4/206 |
| 439,687 | 11/1890 | Reid | 4/205 |
| 903,081 | 11/1908 | Guthrie et al. | 4/202 |
| 975,662 | 11/1910 | Watrous | 4/202 X |
| 1,056,352 | 3/1913 | Moore | 4/199 |
| 1,575,624 | 3/1926 | Correvont | 4/199 |
| 1,593,642 | 7/1926 | Allingham | 4/199 |
| 3,609,776 | 10/1971 | Haldopoulos et al. | 4/295 |
| 4,969,217 | 11/1990 | Gandini | 4/200 |
| 5,012,535 | 5/1991 | Klotzbach | 4/541 |

FOREIGN PATENT DOCUMENTS

| | | | |
|---|---|---|---|
| 3610006 | 10/1987 | Fed. Rep. of Germany | 4/206 |
| 595734 | 10/1925 | France | 4/205 |
| 296601 | 2/1954 | Switzerland | 4/541 |
| 302791 | 10/1954 | Switzerland | 4/541 |
| 385757 | 3/1965 | Switzerland | 4/203 |

*Primary Examiner*—Henry J. Recla
*Assistant Examiner*—Robert M. Fetsuga
*Attorney, Agent, or Firm*—McGlew & Tuttle

[57] ABSTRACT

The overflow and drain fitting has a drain pipe (10), into which a closing plug (4), a float (3), as well as a mushroom-shaped plug (2) are inserted. The closing plug (4) can be lifted via bars (15), thus opening a partition (**10*b*) between a riser channel (6*b*) and a return channel (6*c*) of a hidden riser pipe (6). With a sealing edge (2*c*) of a mushroom-shaped plug (2), the float (3) forms a check valve, which prevents water that may be contaminanted from returning into the basin (5). The closing plug (4), the float (3), and the mushroom-shaped plug (2) are loosely connected to each other via grasping arms (4*b*, 3*b*) and can be lifted out of the drain pipe (10**) together as one unit to clean the fittings.

17 Claims, 3 Drawing Sheets

OVERFLOW AND DRAIN FITTINGS FOR SANITARY DEVICES

FIELD OF THE INVENTION

The present invention pertains in general to overflow and drain fittings for basins to prevent backflow and in particular to overflow in drain fittings that prevent backflow and are easy to remove and clean.

BACKGROUND OF THE INVENTION

In a prior-art fitting of this type, a check valve is arranged in the drain pipe, and a plug valve that can be actuated via rods is arranged under the check valve below the point of entry to the riser channel of the riser pipe. If the plug valve is closed, the basin can be filled corresponding to the height of the riser pipe. However, when the plug valve is opened when the basin is filled, the water runs off through the drain pipe and the elbow trap connected to it. Finally, the check valve prevents dirt present in the drain from rising up into the basin. However, it is not possible to prevent the drain fittings from becoming soiled and clogged, so that the valves will no longer operate reliably. These drain fittings must therefore be cleaned from time to time. In the case of the prior-art fittings, this is expensive and requires trade skill.

SUMMARY AND OBJECTS OF THE INVENTION

It is an object of the present invention to design overflow and drain fittings of the above-mentioned class, which can be easily mounted and removed for cleaning and can still be manufactured at low cost. This task is accomplished by a mushroom-shaped plug, a float and a closing plug. The closing plug prevents water from going directly into a drain pipe. The mushroom-shaped plug covers an outlet in the basin but still allows water to pass into the outlet. The float is located between the closing plug and the mushroom-shaped plug and when a backflow condition occurs, the float is forced against the mushroom-shaped plug and prevents the backflow from entering the basin. When the basin is to be emptied, the closing plug is opened and the force of the water forces the float away from the mushroom-shaped plug allowing water to flow through the mushroom-shaped plug past the float and past the closing plug. The float and the closing plug are connected to each other loosely and can be lifted out of the drain pipe for cleaning. Consequently, laborious searching for and grasping of the deep-seated closing plug is not necessary with the present invention.

According to a variant of the present invention, the mushroom-shaped plug is also connected to the float. To clean the fittings, the mushroom-shaped plug extending into the basin is lifted out of the drain pipe together with the float valve and the closing plug, which is extremely simple and does not require any trade skills.

According to another variant of the present invention, the closing plug and the float are connected to each other by radially deflectable grasping arms. These two parts can be detached and reconnected in a simple manner. The grasping arms of the closing plug can also serve as guides for the float.

According to still another variant of the present invention, the riser pipe is closed at its upper end with a cover that has a check valve for venting. This prevents water from being discharged in the case of clogging of the riser pipe or the return, or during the drainage of the retained water. Such discharge of water at the top end of the riser pipe may cause great damage. Water is prevented from being discharged especially if the check valve is arranged on the side over the return channel. The partition of the riser pipe does not have to end, as before, in front of the end of the riser pipe, so that this riser pipe can be shorter and can be manufactured in a simpler manner.

The various features of novelty which characterize the invention are pointed out with particularity in the claims annexed to and forming a part of this disclosure. For a better understanding of the invention its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
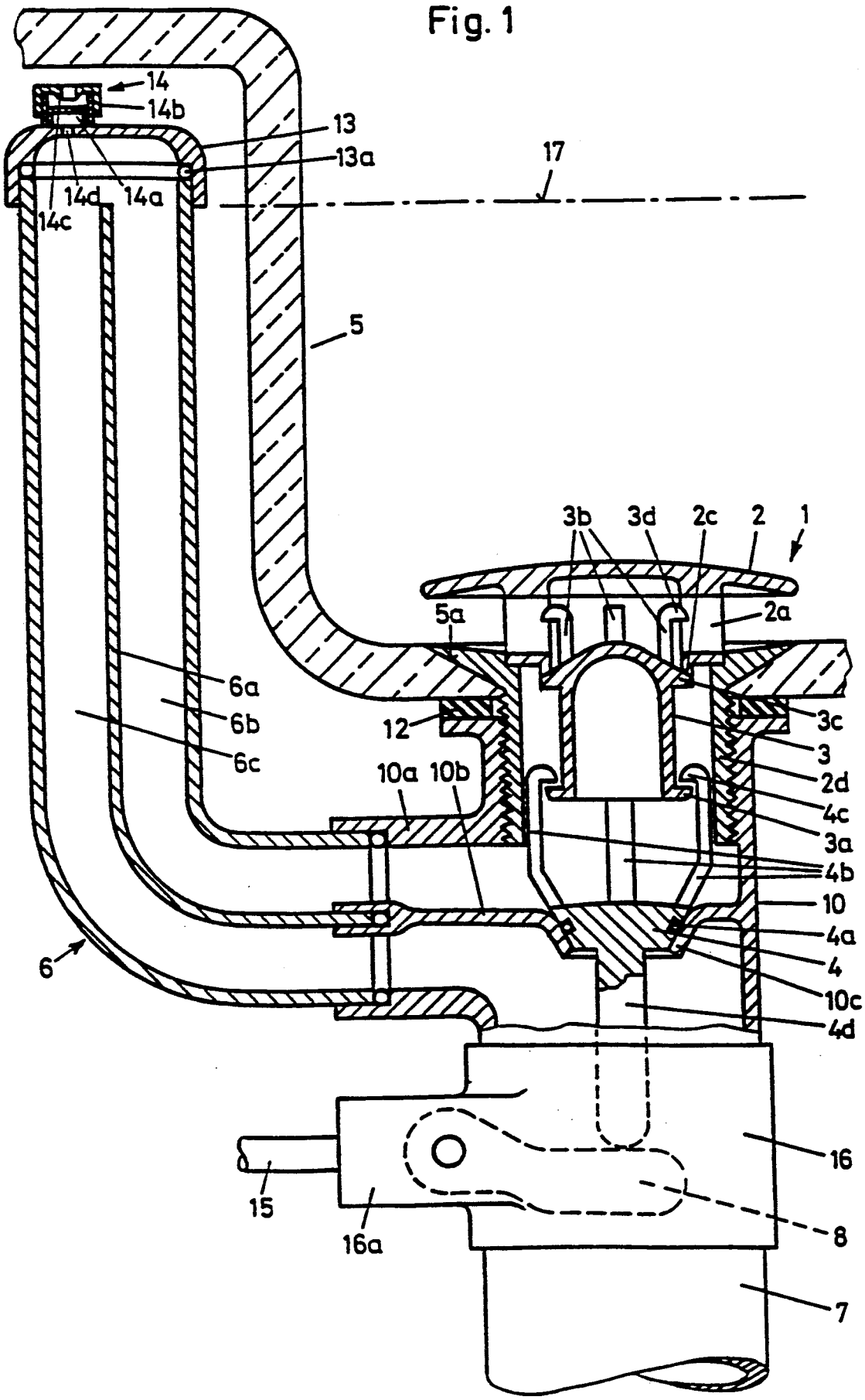
FIG. 1 is a sectional view through overflow and drain fittings, and a section of a wash stand according to the present invention.

In reference to the drawings and to FIG. 1 in particular, a wash stand basin 5 made from a ceramic material is shown only partially. The overflow of the wash stand is formed by a riser pipe 6, which is covered by the wash stand and has a riser channel **6*b* and a return channel 6*c*. The riser pipe 6 is inserted in a sealing manner at the lower end into a union 10*a* of a drain pipe 10. A partition 6*a* extending over the entire length of the riser pipe 6 is also connected to a partition 10*b* of the drain pipe 10 in a sealing manner, and the partition 10*b* has a valve seat 10*c* which cooperates with a closing plug 4 provided with a sealing ring 4*a*. The closing plug 4 can be lifted via rods 15, which are shown here only partially, and the valve seat 10*c* can thus be opened. A lever 8 mounted in a horizontal connection pipe 16*a* of an adapter 16 is now displaced and pivoted horizontally, and the closing plug 4 is thus raised on a downwardly extending shaft 4*d*. If the closing plug 4 has been lifted, water present in the basin 5 is able to run off in the elbow trap 7, shown only partially here, which is screwed to the adapter 16. The water then runs into the drain pipe located downstream of the elbow. If the closing plug 4 is located, as shown in FIG. 1, on the valve seat 10*c*, water entering the basin 5 also enters the riser channel 6*b*, and the basin 5 is filled to the level 17 shown in broken line. Beyond this level, water runs off into the riser pipe 6 through the return channel 6*c***.

To prevent dirt particles from rising into the basin 5 from the drain pipe 10 and the riser pipe 6, a float 3 in the form of a sleeve closed at its top is arranged over the closing plug 4. At its top end, the float 3 has a circular sealing lip **3*c*, which forms a check valve with a sealing edge 2*c* of a cover or mushroom-shaped plug 2. If the riser channel 6*b* and the basin 5 are filled with water, the float 3 is in the position shown in FIG. 1, and the check valve is thus closed. If the closing plug 4** is lifted, the float 3 is pressed down by the water being discharged, and the check valve is thus opened. However, if water flows upward in the drain pipe 10, the check valve is immediately closed, and water that may be contaminated is prevented from entering the basin.

As is apparent from FIG. 1, a threaded sleeve 2*d* is inserted into the drain opening 5*a* of the basin 5 with a sealing collar, and screwed together with the drain pipe 10 via sealing rings 12. The mushroom-shaped plug 2 is inserted into this threaded sleeve such that it can be raised vertically. The float 3 and the closing plug 4 are loosely connected to the mushroom-shaped plug 2, such that the float 3 and the closing plug 4 are also automatically lifted out of the drain pipe 10 when the mushroom-shaped plug 2 is lifted off. To enable the float 3 to move vertically despite its connection to the mushroom-shaped plug 2 and the closing plug 4, upwardly extending grasping arms 4*b* and 3*b* are made in one piece with the closing plug 4 and the float 3, respectively. With the grasping fingers 4*c*, the grasping arms 4*b* extend behind an outwardly extending edge 3*a* of the float 3. The arms 4*b* can also extend into the float 3 from the inside bottom, in which case the edge 3*a* extends radially inwardly. The grasping arms 4*b* are so long that the float 3 is able to reach the position shown in FIG. 1 unhindered. The grasping arms 4*b* also guide the vertical movement of the float 3. The float 3 and the closing plug 4 can be assembled and separated from each other in a simple manner while radially deflecting the grasping arms 4*b*.

The grasping arms 3*b* of the float 3 have radially outwardly extending grasping fingers 3*d*, which extend into passages 2*a* of the mushroom-shaped plug 2. The grasping arms 3*b* permit the desired vertical movement of the float 3, and they also make it possible to assemble and separate the mushroom-shaped plug 2 and the float 3 in a simple manner, e.g., for cleaning, by a corresponding radial deflection.

In order to prevent water from being discharged at the top end of the riser pipe 6 and to guarantee venting, a cover 13 with a sealing ring 13*a* is placed on the riser pipe 6 in a sealing and detachable manner. A check valve 14 is arranged on the cover 13, and the check valve 14 has a valve disk 14*a* above a relatively small air outlet opening 14*d*. The valve disk 14*a* is lifted against a valve seat 14*c* of a cap 14*b* placed on the cover 13 in the case of the entry of water.

Figure 2:
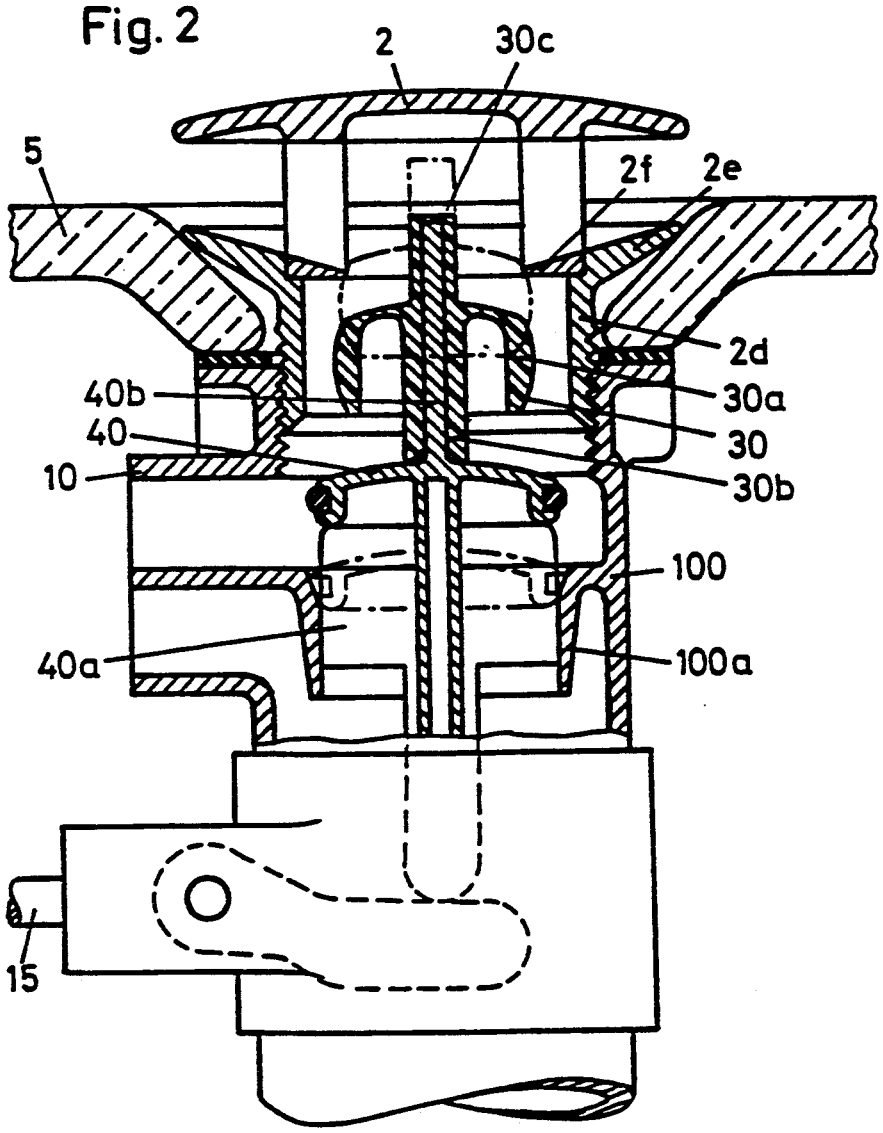
FIG. 2 is a sectional view through another design of the drain fittings.

FIG. 2 shows another embodiment of the drain fittings. A mushroom-shaped plug 2 is removably inserted into an opening of the basin 5 in a collar 2*e* of a threaded sleeve 2*d* in this case as well. As in the first embodiment, a closing plug 40 can be lifted by means of bars 15 or the like to open the drain valve. During this movement, as well as during dropping back onto the valve seat, the closing plug 40 is guided with downwardly extending guide webs 40*a* on a cylindrical projection 100*a* of the drain pipe 100.

A vertically upwardly extending guide bar 40*b*, on which a float 30 is loosely seated, is also made in one piece with the closing plug 40. Together with a valve seat 2*f* of the plug 2, the float 30 forms the check valve as was discussed in the first embodiment. The float 30 is made in one piece from a suitable plastic and has a guide sleeve 30*b*, a float 30*a* that is open at its bottom, as well as a grip part 30*c* made in one piece with it at its top. If water rises in the drain pipe 100, the float 30 also rises to the position shown by a dash-dotted line, in which the check valve is closed. If the water level in the drain pipe 100 drops, the float 30 also moves downward under its own weight, and is guided during this movement. To clean the drain, the float 30 with the closing plug 40 is lifted out of the drain fittings after removal of the mushroom-shaped plug 2. The closing plug 40 and the float 30 are now connected, as a consequence of a slight wedging of these two parts, in a locking manner.

Figure 3:
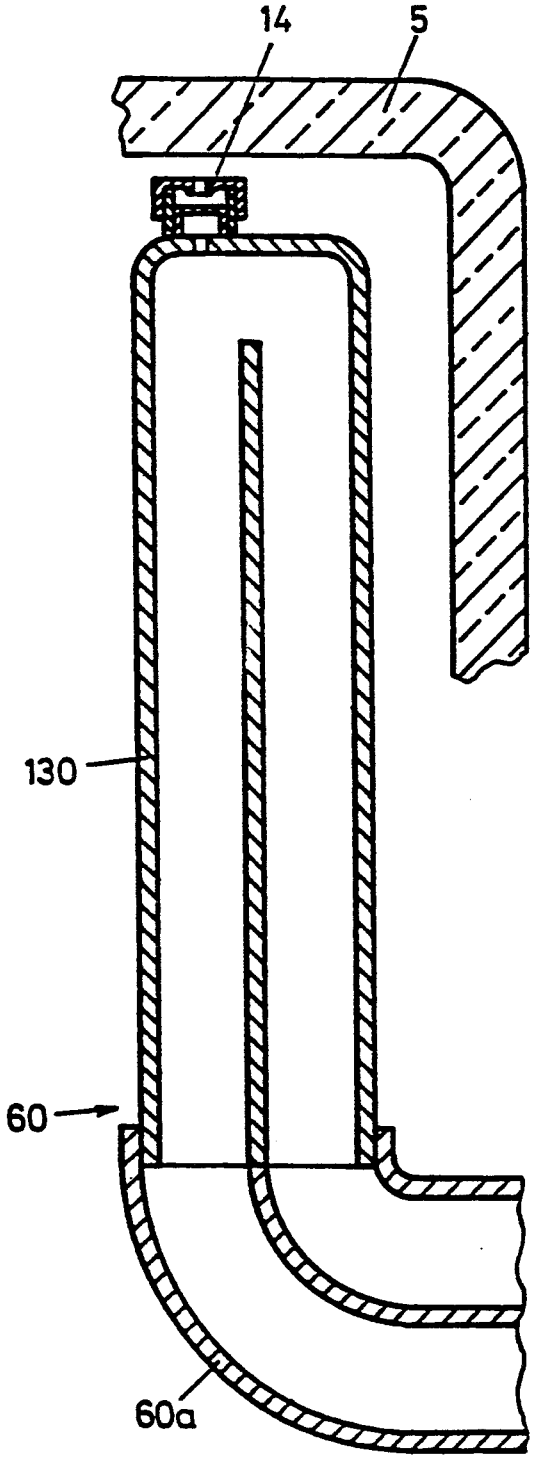
FIG. 3 is a sectional view through another design of the overflow fittings.

FIG. 3 shows an overflow 60, which is suitable for use in conjunction with the drain fittings according to FIG. 1 or FIG. 2. The overflow 60 also has the above-described valve 14, but in this case, it is made in one piece with a cover 130 extended downwardly in a tubular shape. As a consequence of this special design of the cover 130, a connection pipe 60*a* is substantially shorter after its bend, and thus can be manufactured in a simpler manner. The cover 130 and the pipe 60*a* are inserted into each other in a sealing manner.

What is claims is:

1. An overflow and drain fitting, comprising:

a valve seat formed in a drain passage extending through the fitting;

a closing plug movable into a first position against said valve seat for preventing fluids from passing through said valve seat, and movable into a second position for passing fluids through said valve seat;

a cover plug mounted on an opening of the drain passage above the closing plug and having openings for passing water through said cover plug and into the drain passage; an a float movably connected to said cover plug, movable by a backflow condition into contact with said cover plug for preventing backflow of fluid from passing through the drain passage, and movable away from said cover plug by fluid entering the drain passage through the cover plug when said closing plug is in said second position, said float and said cover plug being removable from the fitting as a single unit.

2. A fitting in accordance with claim 1, wherein:

said cover plug is a mushroom-shaped plug, and has a seating edge in cooperation with said float for preventing backflow.

3. A fitting in accordance with claim 1, wherein:

said closing plug is movably connected to said float, and said cover plug, float and closing plug being removable as a single unit.

4. A fitting in accordance with claim 1, wherein:

said closing plug is connected to said float with grasping arms for limited displacement of said float in an axial direction.

5. A fitting in accordance with claim 4, wherein:

said grasping arms of said closing plug have radially extending fingers; and said closing plug has a radially extending edge forming a stop for said grasping fingers.

6. A fitting in accordance with claim 4, wherein:

said grasping arms can be elastically deflected in a radial direction.

7. A fitting in accordance with claim 4, wherein:

said grasping arms are made in one piece with said closing plug.

8. A fitting in accordance with claim 1, wherein:

said cover plug is connected to said float with grasping arms for limited displacement of said float in an axial direction.

9. A fitting in accordance with claim 8, wherein:

said grasping arms have radially extending fingers; and said cover plug has a radially extending edge forming a stop for said grasping fingers.

10. Device in accordance with claim 8, wherein:

said grasping arms can be elastically deflected in a radial direction.

11. A fitting in accordance with claim 1, wherein:

said float is guided during movement toward and away from the cover plug.

12. A fitting in accordance with claim 1, wherein:

said float is guided on said closing plug.

13. A fitting in accordance with claim 1, wherein:

said float is connected to said closing plug by a frictional connection.

14. A fitting in accordance with claim 1, further comprising:

a riser channel connected to one side of said valve seat; and a return channel connected to another side of said valve seat, said return channel and said riser channel being connected at an overflow point, said overflow point being spaced from said valve seat.

15. A fitting in accordance with claim 14, wherein:

said connection of said riser and return channel at said overflow point is covered and has a check valve for venting.

16. A fitting in accordance with claim 15, wherein:

said check valve is arranged above said return channel.

17. A fitting in accordance with claim 15, wherein:

said riser channel and said return channel are separated by a common wall extending between said overflow point and said valve seat;

said riser and return channel being formed of first and second parts, said first part being in connection with said valve seat and having a bend, said second part being straight and having said cover on one end and being connected to said first part on another end.

* * * * *